United States Patent [19]

Mar

[11] 4,203,532

[45] May 20, 1980

[54] SAFETY CONTAINERS

[76] Inventor: Bob Mar, Stockton, Calif.

[21] Appl. No.: 22,016

[22] Filed: Mar. 19, 1979

Related U.S. Application Data

[62] Division of Ser. No. 909,332, May 25, 1978, Pat. No. 4,146,146.

[51] Int. Cl.[2] ..... B65D 5/32; B65D 55/02; B65D 25/42

[52] U.S. Cl. ..... 222/153

[58] Field of Search ..... 215/213, 211, 214, 317, 215/217; 222/153

[56] References Cited

U.S. PATENT DOCUMENTS

| | | | |
|---|---|---|---|
| 3,860,135 | 1/1975 | Yung | 215/213 |
| 3,924,768 | 12/1975 | Lemons | 215/213 |
| 3,927,805 | 12/1975 | Stull | 222/153 |
| 4,022,352 | 5/1977 | Pehr | 222/153 |
| 4,047,643 | 9/1977 | Hazard | 222/153 |
| 4,065,035 | 12/1977 | Eissler | 222/153 |

*Primary Examiner*—George T. Hall
*Attorney, Agent, or Firm*—Townsend and Townsend

[57] ABSTRACT

An improved container and safety stopper combination of the type which includes a container, a stopper hingedly connected to the lip of the container, the pin slidably mounted in a slide channel formed in the stopper and having an enlarged outer portion adapted to engage a recess in the lip of the container to lock the stopper in its closed position. Means are provided to prevent the pin from sliding outwardly or inwardly unless manually pulled or pushed respectively. When the stopper is closed and the pin is fully inserted, the upper side of the enlarged outer portion of the pin is spaced from the stopper the minimum distance sufficient to allow the fingernail of an adult user to fit within a laterally extending groove in the enlarged outer portion so that the pin can be pulled outwardly. Also disclosed is a safety cap including a stopper seat which can be permanently attached to the lip of a container for liquids, a stopper hingedly connected to the stopper seat, and a pin slidably mounted in a channel formed in the stopper. When the stopper is closed, a plug extending from the stopper seals the passage extending through a spout which projects upwardly from the stopper seat. Thereafter, when the pin is fully inserted, a flange on the spout engages the pin and prevents the stopper from being swung to its open position.

4 Claims, 12 Drawing Figures

SAFETY CONTAINERS

This is a division of application Ser. No. 909,332, filed May 25, 1978, now U.S. Pat. No. 4,146,146.

BACKGROUND OF THE INVENTION

This invention relates to containers with safety caps, and more particularly, the invention relates to an improvement over the invention described and claimed in U.S. Pat. No. 3,860,135 issued to Michael A. Yung and Bob Mar, the applicant herein.

Various state and federal regulations require or will require that medicine bottles and bottles containing poisons have safety caps which cannot be opened by young children. Such caps are typically tested by placing them in the hands of children below the age of five years to determine how many of the children can open them within a five minute period. The caps must, however, be readily openable by an adult, and it is expected that as a child matures he will also be able to open them.

A number of containers with safety caps or stoppers have been invented. In one design, the user must obtain the correct rotational alignment between the cap and the container lip before the cap can be lifted off. In another design, the user must simultaneously push the cap downwardly against the container lip and rotate the cap relative to the container so that the threads on the container lip and the cap become engaged and the cap can be screwed off of the container.

U.S. Pat. No. 3,924,768, assigned to the applicant herein, discloses a three-part cap comprising a stopper seat which may be permanently attached to the container or bottle, a stopper which may be hinged to the stopper seat, for example, by a flexible hinge, and a pin which is positioned and adapted to slide in the stopper from one recess on one side of the stopper seat, through a slide channel in the stopper, into a recess on the other diametrically opposed side of the stopper seat. A tang is provided on the protruding end of the pin so that a user can grasp the tang with his fingernail to withdraw the pin from engagement with the slide channel in the stopper, thereby allowing the stopper to be removed from the stopper seat.

The above-referenced patent issued to Yung and Mar discloses a container with a safety cap or stopper which is an improvement over the invention disclosed in the above-referenced patent assigned to applicant. The flange of the stopper is permanently connected to the lip of the container by a U-shaped hinge member. No stopper seat is required. The underside of the stopper is provided with a slide channel which extends diametrically across the stopper and receives a pin. The slide channel and pin have mutually engaging stops which prevent complete withdrawal of the pin from the stopper. The lip of the container has a pair of diametrically opposite recesses which are in alignment with the slide channel and receive the pin. One of the recesses is formed in the shape of an inverted T. When the stopper closes the container, the pin can be pushed inwardly and a pair of ears on one end of the pin will fit within the circumferentially directed slots of the T-shaped recess. The other end of the pin will fit within the opposite recess. In this manner, the stopper is locked to the container. When the pin is pulled outwardly a predetermined distance, the other end of the pin will become disengaged from its corresponding recess, and the ears on the one end of the pin will become disengaged from the circumferentially directed slots of the T-shaped recess. The narrower portion of the pin can be freely lifted through the T-shaped recess and the stopper can be lifted to open the container. The upper side of the pin adjacent the ears is provided with a tang which can be grasped by the fingernail of a user to pull the pin outwardly.

SUMMARY OF THE INVENTION

The present invention provides an improvement over the container and safety stopper disclosed in the above-referenced patent issued to Yung and Mar. The stopper has a flange sized to rest against and conform to the lip of the container. The stopper and container are hingedly connected by a compact flexible member attached between the flange and lip. The flexible member is positioned and sized so that the flange and lip are tightly abutted when the stopper is closed. The stopper has at least one raised annular portion for providing a seal between the container and the stopper.

The slide channel extends only partially across the stopper from its periphery and the pin engages only one recess in the lip of the container. The slide channel is completely enclosed except for an opening at the periphery of the stopper where it receives the pin.

The enlarged outer portion of the pin is sized to tightly fit within the recess in the lip so that it will not slide outwardly unless manually pulled. Means are provided for preventing the pin from sliding inwardly unless manually pushed. The outer end of the pin is shaped to conform to the outer surface of the lip when the pin is fully inserted in the slide channel.

The enlarged portion of the pin has a laterally extending groove opening on its upper side which is adapted to receive the fingernail of an adult user. When the stopper is closed and the pin is fully inserted the upper side of the enlarged portion of the pin is spaced from the flange the minimum distance sufficient to allow the fingernail of an adult user to fit within the groove in the pin so that the pin can be pulled outwardly.

The present invention also provides a safety cap for containers commonly found in the home which hold hazardous liquids. The safety cap includes a stopper seat which can be permanently attached to the lip of the container, a stopper hingedly connected to the stopper seat, and a pin slidably mounted in a channel formed in the stopper. When the stopper is closed, a plug extending from the stopper seals the passage extending through a spout which projects upwardly from the stopper seat. Thereafter, when the pin is fully inserted a flange on the spout engages the pin and prevents the stopper from being swung to its open position.

The present invention will be better understood from the following description considered in connection with the accompanying drawings in which preferred embodiments of the invention are illustrated by way of example. The drawings are for the purpose of illustration and description only and are not intended as a definition of the limits of the invention.

DESCRIPTION OF THE PREFERRED EMBODIMENTS

Figure 1:
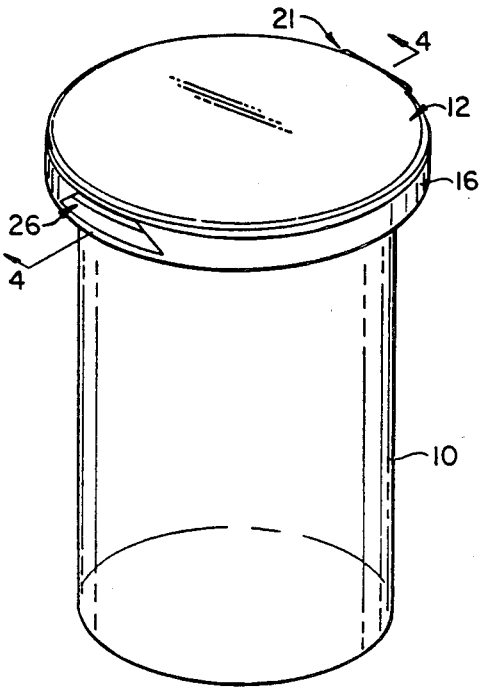
FIG. 1 is an isometric view of one embodiment of the present invention with the stopper closed.
Figure 2:
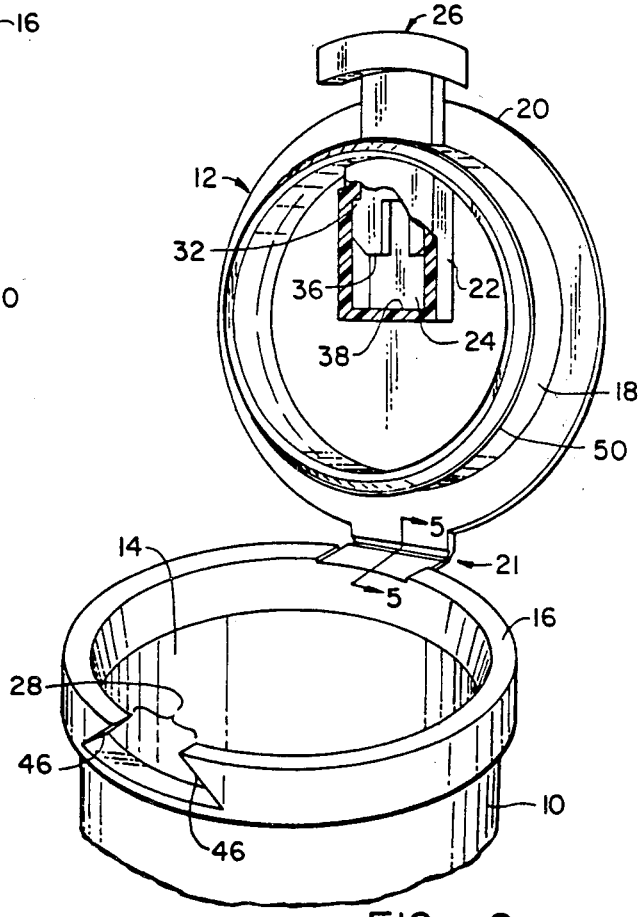
FIG. 2 is a fragmentary isometric view of the embodiment of FIG. 1 showing the stopper open with the pin fully extended.

Referring to FIG. 1, one embodiment of the present invention is a medicine vial which comprises a cylindrical container 10 and a stopper 12. Referring to FIG. 2, the container has a mouth 14, and a lip 16 surrounding the mouth. Stopper 12 has a neck 18 sized to fit into and conform to mouth 14, and a flange 20 sized to rest against and conform to lip 16. Flange 20 of stopper 12 is connected to lip 16 of container 10 by a hinge assembly 21. Formed on the underside of stopper 12 is a rectangular housing 22 which extends partially across stopper 12 from its periphery. Housing 22 defines a slide channel 24 within it, and a pin 26 is mounted in slide channel 24. Lip 16 has a recess 28 which is aligned with slide channel 24 when stopper 12 is closed.

Figure 3:
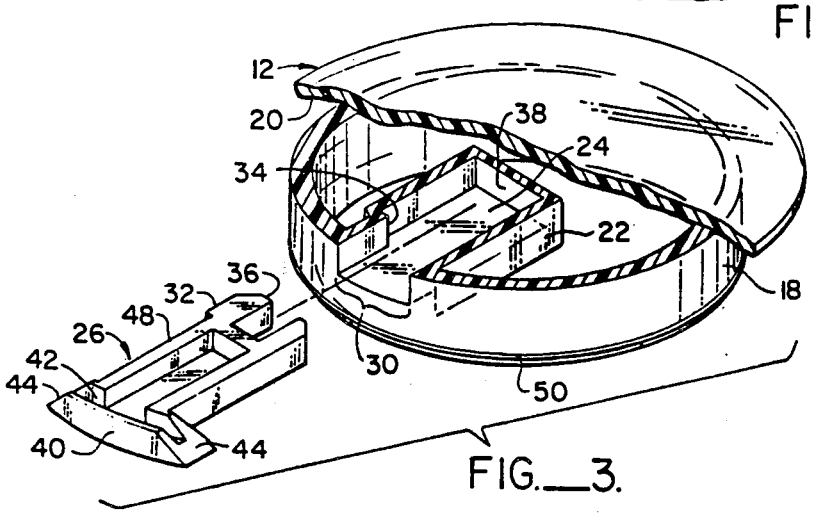
FIG. 3 is an enlarged isometric view of the stopper shown in FIGS. 1 and 2 with parts broken away.

Referring to FIG. 3, slide channel 24 is completely enclosed, except for an opening 30 at the periphery of stopper 12 where housing 22 receives pin 26. It is important that the slide channel be completely enclosed so that liquid or powder within container 10 does not enter the slide channel and find its way to the exterior of the container through opening 30. Also, if substances should enter slide channel 24, they may interfere with the proper operation of pin 26.

Continuing with FIG. 3, pin 26 has a shoulder stop 32 which engages a shoulder 34 formed in housing 22 to prevent complete withdrawal of pin 26 from slide channel 24. Inner end 36 of pin 26 abuts rear wall 38 of housing 22 to limit the amount that the pin can be inserted in slide channel 24. Pin 26 has an enlarged outer portion 40 which has a laterally extending groove 42 that opens on its upper side. The groove is adapted to receive the fingernail of an adult user.

As shown in FIGS. 2 and 3, recess 28 and enlarged portion 40 are trapezoidal in section taken perpendicular to the direction of extension of housing 22 and the axis of slide of pin 26. Enlarged portion 40 is sized to tightly fit within recess 28 so that pin 26 will not slide outwardly from its inserted position unless manually pulled. It has been found that the mating beveled portions 44 and 46 of enlarged portion 40 and recess 28 respectively cooperate to produce a tight fit. Enlarged portion 40 cannot be lifted through recess 28, however, when pin 26 is fully extended, the remaining portion 48 of the pin is sufficiently small so that it can be lifted through recess 28.

As shown in FIGS. 1 and 3, the outer end of enlarged portion 40 is shaped to conform to the outer surface of lip 16 when pin 26 is fully inserted. When stopper 12 is closed, the upper side of enlarged portion 40 is spaced from flange 20 the minimum distance sufficient to allow the fingernail of an adult user to fit within groove 42. This distance may substantially correspond to the width of groove 42. As shown in FIGS. 2 and 3, neck 18 of stopper 12 has a raised annular portion 50 which provides a seal between container 10 and stopper 12 when the stopper is closed.

Figure 5:
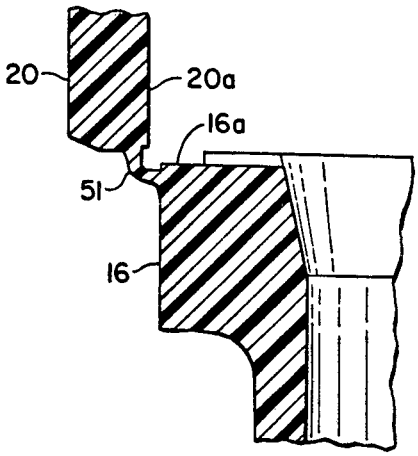
FIG. 5 is an enlarged fragmentary sectional view of the hinge assembly taken along line 5—5 of FIG. 2.

The construction of hinge assembly 21 is shown in detail in FIG. 5. A compact flexible member 51 is attached between flange 20 and lip 16. Member 51 is offset from surfaces 20*a* and 16*a* of flange 20 and lip 16, respectively. As shown in FIG. 2, surface 16*a* is slightly recessed from the remainder of the upper surface of lip 16. The hinge assembly is constructed in this manner to ensure that flange 20 and lip 16 are abutted all the way around the container when stopper 12 is closed.

Figure 4A:
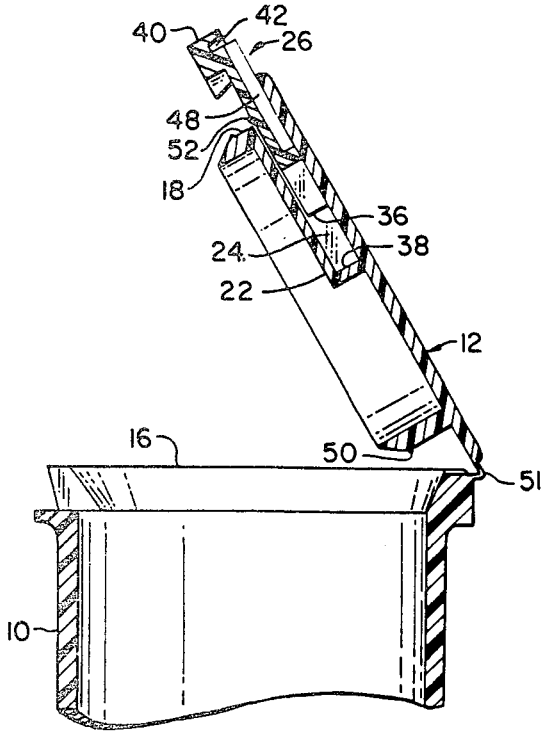
FIGS. 4*a*–4*c* are sectional views of the embodiment of FIG. 1 taken along line 4—4 of FIG. 1 showing the manner in which the container is opened and closed.
Figure 4D:
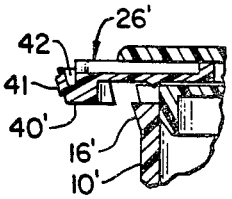
FIGS. 4*d* and 4*e* are fragmentary sectional views of a first alternate embodiment.
Figure 4B:
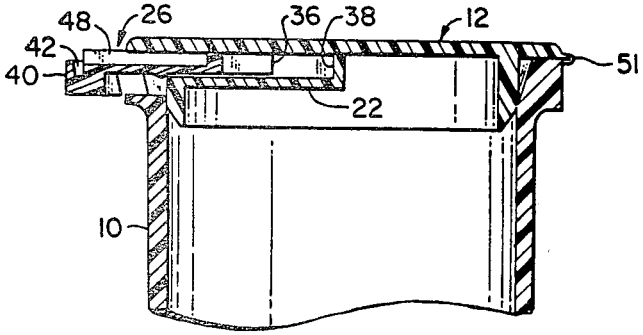
Figure 4E:
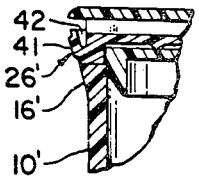
Figure 4C:
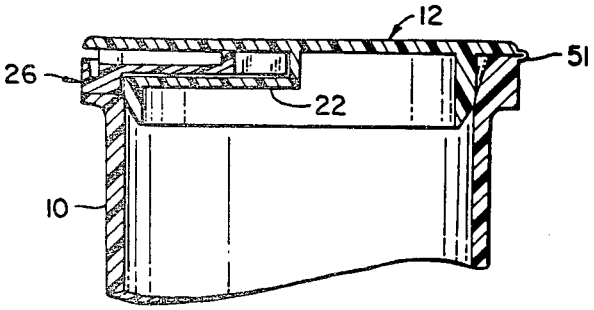

FIGS. 4*a*–4*c* illustrate the manner in which the embodiment of FIG. 1 is opened and closed. In FIG. 4*a*, stopper 12 is open and pin 26 is fully extended. The remaining portion 48 of pin 26 has a downwardly projecting bump 52 which prevents pin 26 from sliding inwardly under its own weight or due to vibrations. Pin 26 will slide inwardly only when manually pushed. This is a convenient feature of the present invention since it eliminates the annoying necessity of having to pull the pin outwardly a second time after the stopper has been opened before it can be closed again.

In FIG. 4*b*, stopper 12 has been closed. Neck 18 fits within mouth 14 and annular portion 50 provides a seal between stopper 12 and container 10. Flange 20 rests firmly against lip 16. Pin 26 is still fully extended. In FIG. 4*c*, pin 26 has been manually pushed inwardly so that enlarged portion 40 fits tightly within recess 28 and stopper 12 is locked in its closed position.

The container is opened by inserting a fingernail in groove 42 and pulling pin 26 outwardly until enlarged portion 40 is disengaged from recess 28. Stopper 12 is then lifted. The embodiment of FIG. 1 is preferably molded out of a plastic material which is strong and durable. One suitable material is polypropylene.

Referring to FIGS. 4*d* and 4*e*, a first alternate embodiment of the present invention is similar in all respects to the embodiment already described except that lip 16′ (around its entire circumference) and outer pin portion 40′ of pin 26′ are configured so that their outer surfaces diverge upwardly and outwardly with respect to the longitudinal axis of container 10′. The configuration of lip 16′ lessens production time because the reduction in the wall thickness permits the plastic to set more quickly. The outer surface of pin portion 40′ can be molded with raised indicia 41 which may indicate any desired legend, e.g. "PULL". In addition, the configuration of lip 16′ and pin portion 40′ further inhibits opening by children.

The embodiments shown in FIGS. 1–5 represent a significant improvement in the field of safety containers. As shown in FIGS. 1, 4*c* and 4*e*, when the stopper is locked in its closed position, the outer end of the pin is flush with the lip and thus it cannot be grasped except by inserting a fingernail into groove 42. The enlarged portion of the pin fits tightly within the recess in the lip and the pin will not move outwardly unless manually pulled so that accidental opening is prevented. Generally, the fingernails of a young child lack the length and rigidity to enable the child to withdraw the pin. Because of the minimal distance between the upper side of the enlarged portion of the pin and the flange of the stopper, it is unlikely that a young child would be able to insert an implement and pull the pin outwardly.

Since the flange of the stopper rests against the lip of the container, it would be difficult if not impossible for a young child to pry the stopper and container apart by inserting an implement between them. The compact design of the hinge is an important advancement over the U-shaped hinges of prior containers which can be broken, for example, by inserting a pencil between the legs of the U and twisting it.

Figure 6:
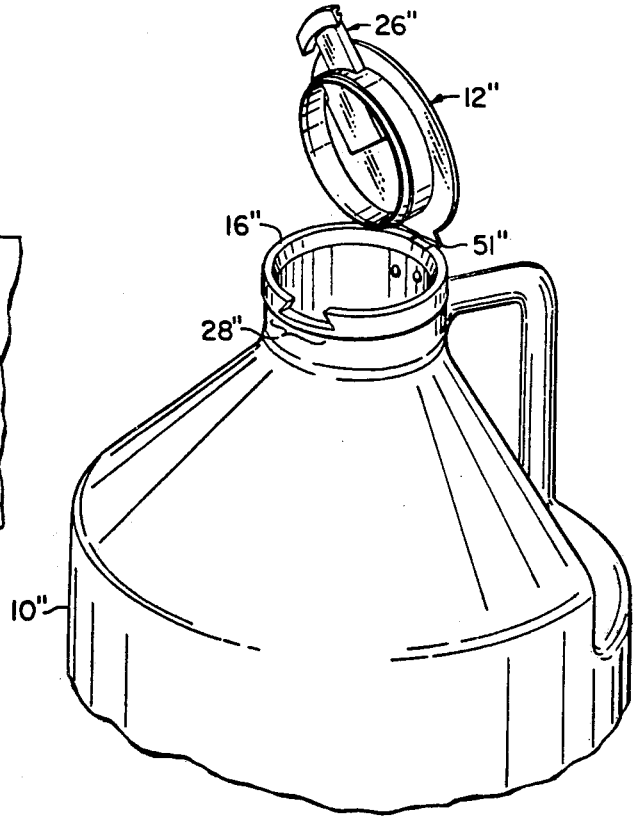
FIG. 6 is an isometric view of a second alternate embodiment of the present invention.

The present invention is not limited solely to medicine vials but may also be used in conjunction with many other kinds of containers. For example, FIG. 6 shows a second alternate embodiment in the form of a relatively large hand-held container 10″ for toxic liquids such as bleach, insecticide, etc. Typically this kind of container is made out of ethylene and is widely manufactured using a technique known as compression blow molding. Container 10″ has a lip 16″ with a recess 28″. A stopper 12″ with a pin 26″ is connected to lip 16″ by a hinge member 51″. The stopper and pin may be molded out of polypropylene.

Figure 6A:
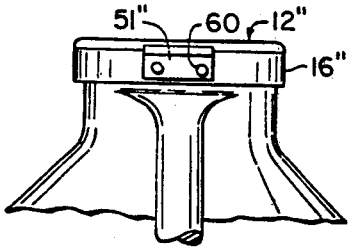
FIG. 6*a* is a fragmentary elevational view of the hinge assembly of the second alternate embodiment shown in FIG. 6.

Referring to FIG. 6*a*, one end of hinge member 51″ is integrally molded to stopper 12″ and the other end is attached to lip 16″ by rivets 60. If desired, the other end of hinge member 51″ can be welded to lip 16″ by applying heat or sonic vibrations.

Figure 7:
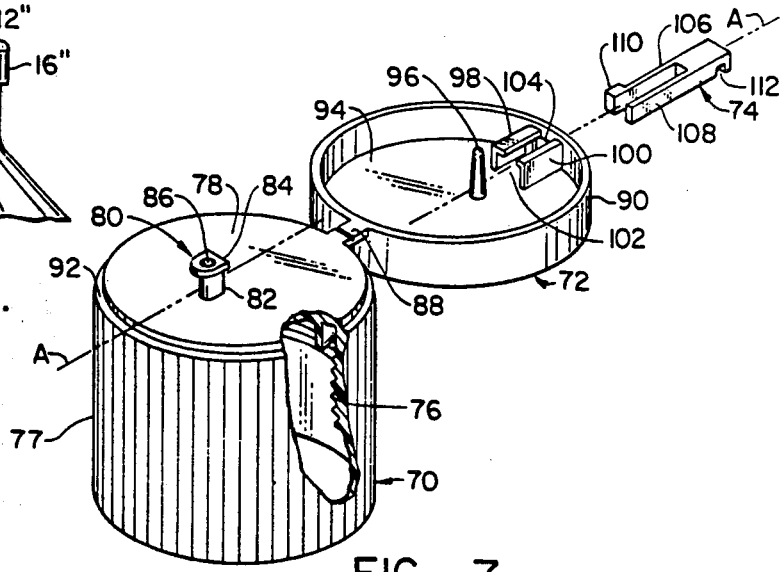
FIG. 7 is an isometric view of a third alternate embodiment of the present invention with parts broken away showing the stopper open and the pin completely withdrawn.

FIG. 7 shows a third alternate embodiment of the present invention in the form of a safety cap for containers commonly found in the home which hold hazardous liquids such as lighter fluid, ammonia, etc. The safety cap includes a stopper seat 70, a stopper 72, and a pin 74. Stopper seat 70 is sized to fit over the mouth of a container and it is permanently attached to the lip of the container with threads 76 of a known design which permit it to be screwed on but not off. The stopper seat may be permanently attached to the container lip in any convenient manner.

Stopper seat 70 has a cylindrical configuration which includes sides 77 and top end 78. A spout 80 having a tubular portion 82 and a flange 84 at the upper end of the tubular portion projects upwardly from top end 78. A passage 86 extends through spout 80 and stopper seat 70. Liquid from the container can flow through passage 86 when stopper 72 is open.

Stopper 72 also has a cylindrical configuration and it is sized to fit over top end 78. Stopper 72 is hingedly connected to stopper seat 70 by a compact flexible member 88 which is positioned and sized so that the surrounding neck 90 of the stopper rests firmly against groove 92 of the stopper seat when the stopper is swung to its closed position. The under side 94 of the stopper has a slightly tapered plug 96 which is adapted and aligned so that it will project into and seal passage 86 when the stopper is closed.

Mounted to under side 94 are a pair of L-shaped guides 98 and 100 which define a slide channel 102 aligned with a recess 104 in neck 90. Pin 74 is inserted through recess 104 into slide channel 102 and is slidable from an inserted position in which its two spaced apart, parallel legs 106 and 108 of its inner portion extend on opposite sides of plug 96, to an extended position in which shoulder 110 of leg 106 abuts guide 98 to prevent complete withdrawal of the pin. Spout 80, member 88, plug 96, channel 102, recess 104, and pin 74 are aligned along line A.

The outer portion of pin 74 has a laterally extending groove 112 that opens on the upper side of the pin. When pin 74 is in its inserted position, groove 112 is spaced from under side 94 the minimum distance sufficient to allow the fingernail of an adult user to be inserted in the groove so that the pin can be pulled outwardly. Pin 74 may have a bump (not shown) similar to bump 52 for preventing the pin from sliding inwardly from its extended position unless manually pushed.

When pin 74 is in its extended position, stopper 72 can be swung from its opened position shown in FIG. 7 to its closed position in which plug 96 will seal passage 86. Thereafter, pin 74 can be pushed to its inserted position in which its legs 106 and 108 will extend on opposite sides of tubular portion 82 of spout 80. When the pin is in this position, flange 84 will engage the pin and prevent its upward movement so that stopper 72 cannot be swung to its open position.

Thus, the present invention presents significant improvements in the field of safety containers. The previously described embodiments can be easily opened by an adult, however, it is very difficult, if not impossible, for a young child to open them. A safety container or cap constructed in accordance with the present invention is relatively simple to manufacture and assembly and the finished products, if made of conventional materials, are very durable.

While preferred embodiments of the present invention have been illustrated in detail, it is apparent that modifications and adaptions of those embodiments will occur to persons skilled in the art. For example, the stoppers may have two or more slide channels positioned along chords. The position of the channels and the shapes of the pins can be varied. The invention is adaptable to any kind of container which, for safety reasons, must be designed so that it will be difficult for a young child to open. It is to be expressly understood that such modifications and adaptations are within the spirit and scope of the present invention as set forth in the following claims.

I claim:

1. A safety cap for dispensing liquids from a container having a mouth and a lip surrounding the mouth, the safety cap comprising:

a stopper seat sized to fit over the mouth of the container and having a passage extending through it;

a stopper sized to fit over the stopper seat and having an upper side, an under side, and a neck adapted to rest against the stopper seat, the neck having a recess extending through it, the stopper further having a slide channel extending across its underside and aligned with the recess;

hinge means for connecting the stopper to the stopper seat so that the stopper can be swung from a closed position in which the neck rests against the stopper seat to an open position;

a spout aligned with the slide channel and projecting upwardly from the stopper seat, the spout having a tubular portion, a flange at the upper end of the tubular portion, and a passage extending through the tubular portion and flange which communicates with the passage extending through the stopper seat;

a plug extending from the under side of the stopper, the plug adapted and aligned so that will project into and seal the passage extending through the tubular portion and flange when the stopper is swung to its closed position; and a pin slidable in the recess and the slide channel from an inserted position to an extended position, the pin havng an outer portion and an inner portion, the inner portion including two spaced apart legs which extend on opposite sides of the plug, the legs extending on opposite sides of the tubular portion when the stopper is in its closed position and the pin is slid to its inserted position so that the flange will engage the pin and prevent the stopper from being swung to its open position.

2. A safety cap according to claim 1 and further comprising means for permanently attaching the stopper seat to the lip of the container.

3. A safety cap according to claim 1 and further comprising means for preventing the pin from sliding inwardly from its extended position unless manually pushed.

4. A safety cap according to claim 1 wherein the pin has an upper side and an under side, and a laterally extending groove that opens on the upper side of the pin, the groove adapted to receive the fingernail of an adult user so that the pin can be pulled outwardly.

* * * * *